US006368228B1

(12) United States Patent
Lanzetta

(10) Patent No.: US 6,368,228 B1
(45) Date of Patent: Apr. 9, 2002

(54) COVER FOR THE RAILS OF A BOWLING BALL RETURN

(76) Inventor: Vincent F. Lanzetta, 5041 Lofton Dr., New Port Richey, FL (US) 34652

( * ) Notice: Subject to any disclaimer, the term of this patent is extended or adjusted under 35 U.S.C. 154(b) by 0 days.

(21) Appl. No.: 09/731,944

(22) Filed: Dec. 8, 2000

(51) Int. Cl.[7] ..... A63D 5/02
(52) U.S. Cl. ..... 473/111; 473/99
(58) Field of Search ..... 473/54, 97, 98, 473/99, 106, 110, 111

(56) References Cited

U.S. PATENT DOCUMENTS 2,278,193 A * 3/1942 Discher
2,931,651 A 4/1960 Zuercher
2,967,708 A * 1/1961 Huck et al.
3,127,172 A 3/1964 Troiano
4,022,468 A 5/1977 Camilleri
4,320,897 A 3/1982 Fields
4,640,511 A 2/1987 Speranza
4,801,143 A 1/1989 Heddon
5,076,582 A * 12/1991 Edwards
5,868,629 A * 2/1999 VanDuyn et al.

* cited by examiner

*Primary Examiner*—William M. Pierce
(74) *Attorney, Agent, or Firm*—Harold D. Shall

(57) ABSTRACT

A covered rail assembly for the bowling ball return of a bowling alley. The rails are made of cylindrical metal and the cover for the rail fits over the engaging surface thereof and is secured thereto by ties, with the ball engaging surface of the cover of concave semi cylindrical shape so as to conform to a ball's surface contacted thereby. The cover is impregnated with oil absorbing particles.

6 Claims, 2 Drawing Sheets

COVER FOR THE RAILS OF A BOWLING BALL RETURN

BACKGROUND OF THE INVENTION

1) Field of The Invention:

This invention relates to covers for the rails of bowling ball returns generally, and more particularly to such a cover which is configured to provide more than a minimal line contact of the bowling ball and also constructed so as to assist in removing oil from the surface of bowling balls.

2) Description of the prior art:

The rails for ball returns are generally constructed of solid or hollow members or pipes made or a strong metal. A pair of laterally spaced rails contact the balls and support the same as they move in the ball return in a well known manner. These rails, if they directly contact the bowling balls, can impose wear and/or damage on the surface of a ball To alleviate the situation, prior art devices, such as seen at numeral 88 in U.S. Pat. 3,297,322,"are covered with a frictional surface covering, such as rubber tubing, which aids in the elevation of balls". This rubber tubing also, by its very nature, protects the surface of the ball from damage by the direct engagement with the metal rails. However, the contact between the rubber tubing and the rails would be external sphere to external cylinder point contact, were it not for the fact that the rubber tubing can deflect somewhat to thereby give a rolling contact in the neighborhood of 1/16 inch diameter, as has been observed. While the resilience of the rubber material lessens damage to the ball, it does not do so to the extent that a rail cover according to the instant invention does. Additionally, the material of these prior cover does not remove oil from the ball's surface, other than by some incidental wiping, while the material of the instant invention, in itself, contributes to the removal of oil from the surface of the ball

SUMMARY OF THE INVENTION

A rail cover of the instant invention is superior to the prior art covers in two very important aspects, namely, it provides an increase in the contact area between the ball and the supporting surface of the rail cover, and it provides a contacting surface on the rail that can remove oil from the contacting surface of the ball. To that end, the rail covers are provided with a concave semi cylindrical contact surface so that when they are assembled on to the rails they thereby provide a curvilinear contact between the cover of the rail and the ball of substantial magnitude (external sphere to internal cylinder) to thereby lessen the potential for damage to the bowling ball. Additionally, an oil absorbing material comprised of a multitude of oil absorbent fragments, randomly from a powdery minuscule size to about 1/8 inches in diameter, is embedded in the urethane matrix of the cover and these fragments function as oil control modules.

DETAILED DESCRIPTION OF THE PREFERRED EMBODIMENT

Figures 1, 2:
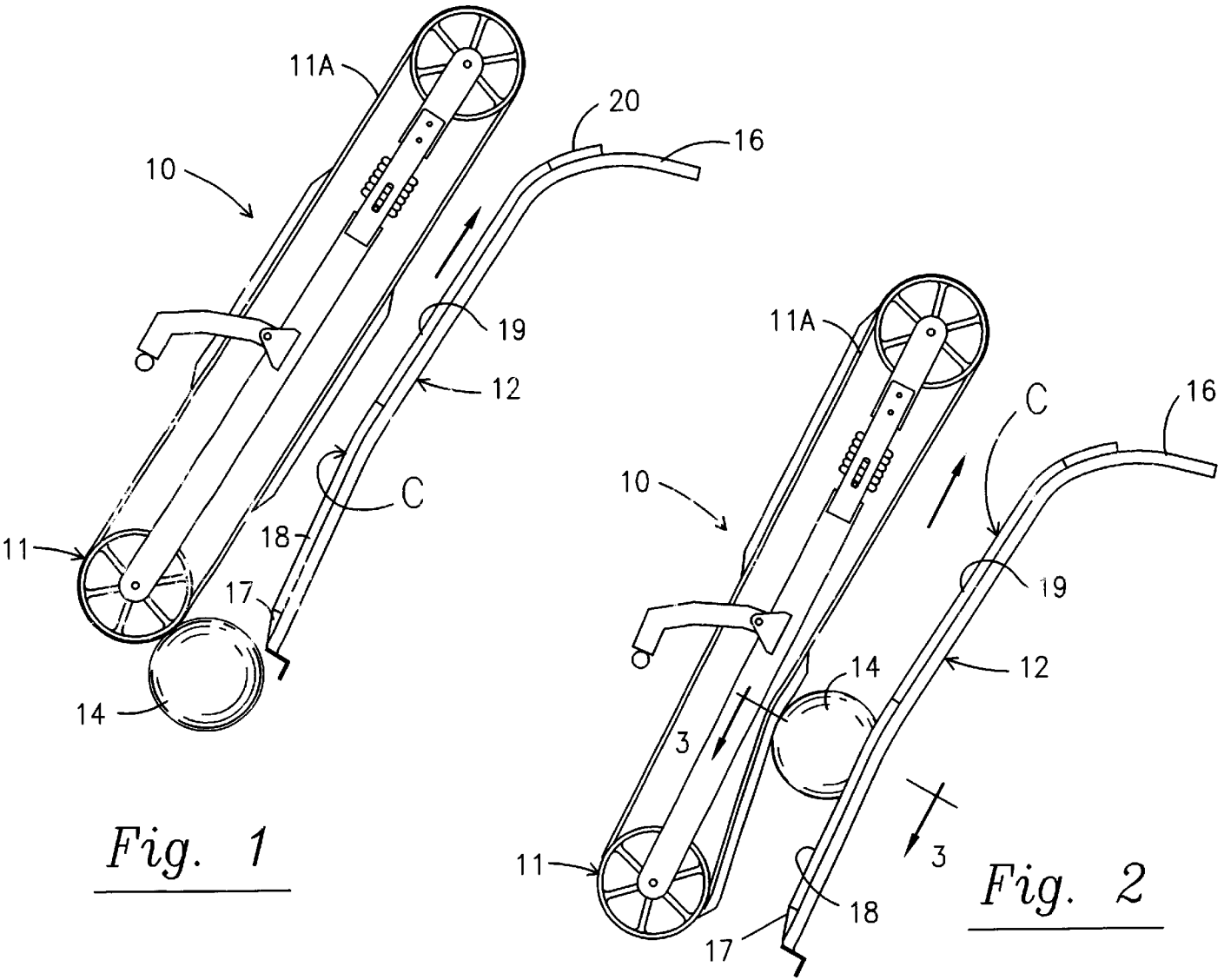
FIG. 1 is a side elevational view of a portion of a ball return assembly showing a ball about to be placed on the covered rail of this invention and showing that a rail cover has four sections.
FIG. 2 is a view like FIG. 1 showing the ball after it has been moved partially up the covered rails.
Figure 3:
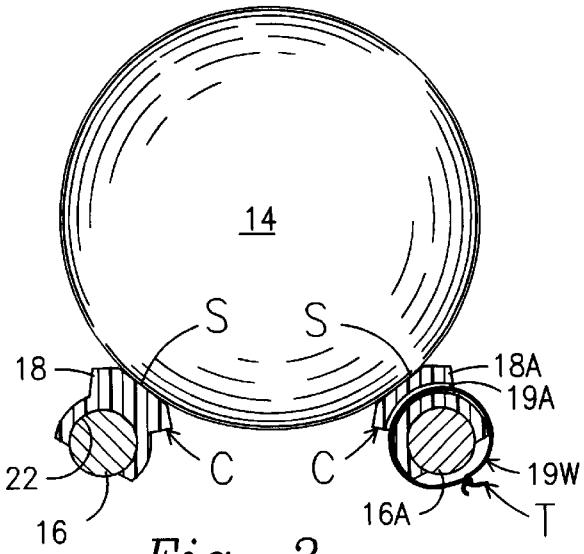
FIG. 3 is a cross sectional view taken along the lines 3—3 in FIG. 2.
Figure 7:
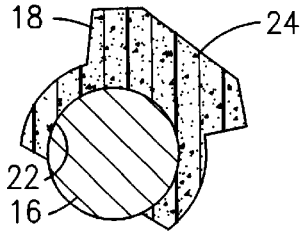
FIG. 7 is an enlarged cross sectional view taken like FIG. 3 showing the scattered particles in the cover.

Referring now to the drawings and more particularly to FIGS. 1 and 2, a portion of a ball return assembly is shown generally at 10, comprised of a conventional ball elevating mechanism 11 including an endless belt 11A which engages a ball 14 to roll the latter, in a well known manner, up a rail assembly shown generally at 12. As seen in FIG. 3, the rail assembly 12 is comprised of a pair of laterally spaced rails 16 and 16A. In FIGS. 1 and 2, it is seen that these conventional rails are angled upwardly and to the right, and the upper end thereof curves back down to end below the horizontal The surface of the rails which faces the ball is the ball engaging surface of the rail.

Figure 4:
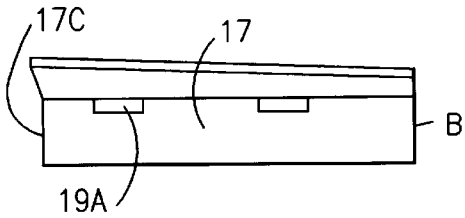
FIG. 4 is a side elevational view of the lowest section of a cover.
Figure 5:
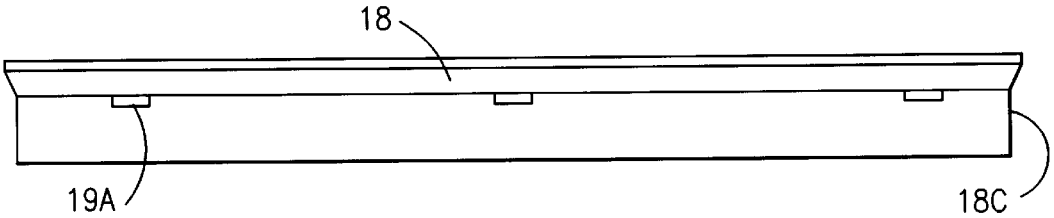
FIG. 5 is a side elevational view of one of the two intermediate sections of a cover.
Figure 6:
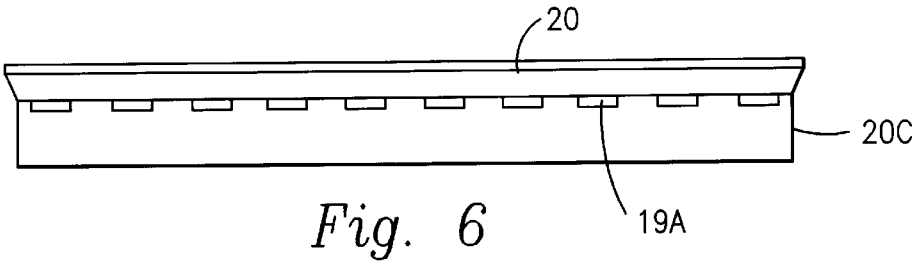
FIG. 6 is a side elevational view of the uppermost section of a cover.

On each of the rails 16 and 16A is a cover assembly C, which assembly comprises four sections, namely, a lower section 17, two intermediate sections 18 and 19, and a top section 61 20. Referring now to FIGS. 4, 5 and 6, each of the sections 17,18,19 and 20 have a plurality of openings in the form of slots 19A extending laterally therethrough, with the upper surface S of the sections being of cylindrical shape so that the contact between the ball 14 and the covers C on the rail assembly 12 is that of the external surface of a sphere contacting a the internal concave wall of a cylinder. The lower portion of each of the 66 sections of the covers C are of an open concave semi-cylindrical shape, as seen at 22 and are closely received on the periphery of the rails 16 and 16 A. Through each of the openings 19A, a securing member in the form of a wire tie 19W is passed, the free ends of the tie are passed under the rail 16 and secured tightly to each other as shown at T to thereby tightly secure the cover C to the rail 16 and 16A. It should be noted that a section 17 is placed on the lower end of the rail 16 with its base end B projecting downwardly and its upper end 17C projecting upwardly. This section is the one that is first struck by the bowling ball as it reaches the assembly 10, and wears out first. It is smaller than the other sections and therefore can be easily and cheaply replaced, and has only two ties 19W therein. Sections 18 and 19 are identical, with the lower end 18C of the section 18 abutting the upper end 17C of the section 17, and its opposite end abutting section 19. The upper end of section 19 engages the lower end 20 C of the section 20, and the upper end of section 20 is free. Section 17 is shown with two openings 19A for receiving ties 19W, longer sections 18 and 19 have three openings 19A for receiving ties 19W, while section 20, because it mounts on a curved upper end of rail 16, is shown with ten openings 19A for receiving ties 19W because it must be bent and held in an arcuate shape to be assembled onto the rail 16.

The cover sections 17,18,19 and 20 are made from a two part mix of urethane (obtained from the Synair Corporation of Chattanooga, Tenn. as"Duothane S601") which is pour cast into its final shape and then cured in a conventional manner to a shore A hardness in the general range of 60, to thereby provide a tough, durable, and resilient cover C. To further the properties of the cover C, the urethane mix, prior to casting, is supplied with, and thereby includes, a quantity of oil and grease absorbent particles 24. These particles 24 as seen in FIG. 8, are then present throughout the structure of the sections 17, 18, 19, and 20, including the upper surface S of the sections which engage the bowling bails. A concentration of approximately 9.6 to 9.8 percent particles to urethane has been found to be adequate to perform the desired function. Once the rail covers are made and installed, the particles are activated by scraping the upper surface S thereof with a sharp utensil until the grey specs of the particles are clearly evident. As the balls traverse the surface S of the sections, the particles aid the cover in removing oil from the surface of the ball A suitable source of the particles is from all purpose oil and grease absorbent material obtainable from auto parts stores, such as Discount Auto Parts. It has been observed that the particle size is in the general range of almost powdery to approximately ⅛ inch diameter. If the surface S and the particles 24 require cleaning, a wipe with acetone will suffice. While it is only the contacting surface S of the covers C that requires the particles 24 to perform the desired oil removing function, for ease of manufacture, they are simply disbursed throughout the urethane, as shown, when it is cast. It could be a two part cast, and thereby only have the particles in the surface area S of the covers C.

While only a single embodiment of this invention has been shown and described, it is apparent that many changes can be made therein without departing from the scope of this invention as defined by the following claims

What is claimed is:

1. A covered rail assembly for use in the bowling ball return of a bowling alley, comprising in combination, a conventional metallic rail having an upper engaging surface, and a cover therefor secured upon the engaging periphery of said rail, said cover being characterized in that a first portion is of concave semi cylindrical shape conforming to the surface of the rail and a second portion thereof securely carried by said first portion and projecting from said first portion has the upper surface thereof which is shaped semi cylindrically after a bowling ball is placed thereon so as to conform to the external configuration of a bowling ball whereby an arcuate line contact will exist between said second portion and a bowling ball placed thereon.

2. A covered rail assembly according to claim 1 wherein said assembly includes means for securing said cover upon said rail.

3. A covered rail assembly according to claim 2 wherein said securing means is a plurality of ties passing through openings in said cover and passing under said rail.

4. A covered rail assembly according to claim 2 wherein said cover is made from urethane having a durometer hardness of approximately 60A.

5. A covered rail assembly according to claim 4 wherein said urethane cover contain approximately 9.7% oil absorbent particles.

6. A covered rail assembly according to claim 5 wherein said particles range in size from powdery to approximately ⅛ inches thick.

* * * * *